United States Patent [19]

Lawrence

[11] Patent Number: 4,694,935

[45] Date of Patent: Sep. 22, 1987

[54] SELF-ADJUSTING CONTROL VALVE FOR ELEVATORS

[75] Inventor: William A. P. Lawrence, Simi Valley, Calif.

[73] Assignee: Cemco, Inc., Plumsteadville, Pa.

[21] Appl. No.: 920,213

[22] Filed: Oct. 17, 1986

[51] Int. Cl.[4] ..... B66B 1/04; F15B 13/043

[52] U.S. Cl. ..... 187/111; 137/596.16

[58] Field of Search ..... 187/110, 111; 137/596.12, 596.13, 596.16; 91/446, 468

[56] References Cited

U.S. PATENT DOCUMENTS

| | | | |
|---|---|---|---|
| 2,355,164 | 8/1944 | Jaseph | 187/111 |
| 3,187,844 | 6/1965 | MacNair et al. | 187/111 |
| 3,706,357 | 12/1972 | Simpson | 187/114 |
| 3,707,166 | 12/1972 | Lawrence | 137/596.16 |
| 3,977,497 | 8/1976 | McMurray | 187/111 |
| 4,000,754 | 1/1977 | Risk | 137/487 |
| 4,011,888 | 3/1977 | Whelchel | 137/596.13 X |
| 4,148,248 | 4/1979 | Risk | 137/596.12 X |
| 4,153,074 | 5/1979 | Risk | 137/596.12 |
| 4,457,211 | 7/1984 | Risk | 137/596.12 X |

FOREIGN PATENT DOCUMENTS 1378345 12/1974 United Kingdom .

*Primary Examiner*—Bernard Roskoski
*Assistant Examiner*—W. E. Duncanson, Jr.
*Attorney, Agent, or Firm*—William H. Eilberg

[57] ABSTRACT

The invention discloses an automated hydraulic valve, for use in an elevator propulsion system. The elevator includes a car which is powered by a piston which moves within a cylinder. The automated valve controls the flow of hydraulic fluid into and out of the cylinder. The valve insures that the acceleration and deceleration of the elevator car will be uniform, and that the acceleration or deceleration will occur over a constant, predetermined interval, regardless of the load in the car. The control valve allows fluid to flow from a reservoir, and into the cylinder or back to the reservoir, with varying rates of flow. When fluid is directed into the cylinder, the elevator ascends. When fluid is allowed out of the cylinder, the elevator descends. The operation of the control valve is governed by a bypass piston assembly which is moved in response to the sensed pressure in the cylinder and the pressure in the valve. The rate at which the bypass piston assembly is moved is precisely controlled, preferably by a microprocessor. The rate of movement of the bypass piston assembly compensates for changes in the weight of the elevator car. The invention therefore also includes a method of controlling a hydraulic valve for an elevator, which method insures that the operation of the elevator will be substantially independent of changing load conditions.

25 Claims, 4 Drawing Figures

SELF-ADJUSTING CONTROL VALVE FOR ELEVATORS

BACKGROUND OF THE INVENTION

This invention relates to the field of elevator control. In particular, the invention is intended for use with hydraulically-propelled elevators, i.e. elevators having cars which are pushed upward by extended pistons, the pistons being mounted for reciprocation within cylinders filled with hydraulic fluid. The main purpose of the invention is to insure that the elevator car will accelerate and decelerate uniformly, and over a fixed, predetermined time interval, regardless of the weight in the car.

It has long been known, in the field of hydraulically-driven elevator systems, that hydraulic pressure must be applied and released gradually, to avoid unpleasant jerks in the elevator ride. This problem is excerbated by the fact that the elevator industry generally uses synchronous motors, which stop and start immediately, when power is applied and cut off. Therefore, it has been known, in the prior art, to provide a control valve which cushions the flow of hydraulic fluid entering or leaving the main cylinder.

The control valves of the prior art are adjusted manually, by adjusting the sizes of their orifices, and by adjusting the stop positions of their moving elements. There may be as many as thirteen separate adjustments which can be made on one such valve. But after these valves have been adjusted, their settings are fixed. The valves are not designed to change their settings while the elevator is moving.

A valve setting which provides a smooth acceleration and deceleration for an empty car will not, in general be the optimum setting for a fully-loaded car. A change in load is not the only possible cause of sub-optimal performance. Changes in temperature affect the viscosity of the oil used as the hydraulic medium, and the fixed settings of the valves of the prior art will not compensate for these changes. The only way to adjust the elevator control valves of the prior art is to deactivate the system, gain access to the control valve, and adjust the orifice sizes as desired. Clearly, it is impractical to adjust the valve whenever the load on the elevator changes.

Valves which depend on adjustment of small orifices are also subject to clogging, due to particles of dirt in the hydraulic fluid. These particles can eventually change the effective orifice size, thus causing the effective settings of the valve to change in an unintended and unpredictable way.

The present invention solves the problems described above, by providing a "smart" valve which automatically adjusts itself according to the load in the elevator car, and according to the measured flow rate of hydraulic fluid through the valve.

The valves used in the prior art also generally require several solenoids, sometimes as many as five. One accomplishment of the present invention is the reduction of the number of solenoids to one.

The valve of the present invention is also much simpler, in construction and operation, than the control valves of the prior art. The valve of the present invention requires only a few electronic settings, which need not be changed during the entire life of the valve. It does not employ small orifices which could cause clogging. The invention provides a feedback loop, which allows the valve to adjust itself in response to changing conditions.

SUMMARY OF THE INVENTION

The valve of the present invention is connected, at one end, to the main hydraulic cylinder of the elevator propulsion system. The fluid in the cylinder is contained by a check valve, the check valve being part of the control valve. The control valve has a bypass piston assembly, mounted to reciprocate within the valve. The bypass piston abuts the check valve; when the bypass piston is pushed towards the check valve with sufficient force, it can open that valve, allowing fluid to flow out of the cylinder.

The bypass piston assembly divides the interior of the valve into three regions, or cavities, within which hydraulic fluid can flow. The first region is nearest the check valve. The third region is farthest from the check valve. A pump directs hydraulic fluid from a reservoir into both of the first and third regions. The bypass piston has a valve element which can open or close a path for fluid flow between the first and second regions. A turbine is connected in the path of fluid exiting the second region, and the outlet side of the turbine is connected to return the fluid to its reservoir.

The rate of fluid flow out of the second region is monitored by measuring the rate of rotation of the turbine. This measurement is preferably done by attaching a multi-pole magnet to the outlet end of the turbine shaft, and by placing a Hall effect sensor near the magnet. Each rotation of the shaft is thereby converted into a series of electrical pulses which can be counted.

The flow of fluid out of the third region is controlled by a needle valve, the linear position of which is carefully controlled. In the preferred embodiment, the needle valve is attached to another magnet, so that the position of the needle valve can be monitored with another Hall effect sensor. The position of the needle valve is preferably controlled by a microprocessor.

The control valve also includes a pressure sensor, for measuring the pressure in the main cylinder, and in the first region.

Movement of the elevator car is accomplished by moving the needle valve back and forth. Movement of the needle valve causes similar movement of the bypass piston assembly, by momentarily disturbing the pressure balance between the first and third regions. When the bypass piston moves sufficiently to close the path between the first and second regions, the pressure in the first region increases, and becomes large enough to overcome the spring force of the check valve. Fluid then flows into the cylinder, and the elevator ascends.

Conversely, when the bypass piston moves so as to open the path between the first and second regions, the pressure in the first region decreases, and the fluid in the first region can no longer be forced into the cylinder. The upward movement of the elevator car is therefore halted.

The movement of the needle valve is carefully timed, so that it causes the car to accelerate at a uniform rate, and over a constant, preselected time interval.

To make the elevator car descend, a solenoid-operated pilot valve is first opened, allowing a small stream of hydraulic fluid out of the cylinder. At the same time, the needle valve is moved so as to cause the bypass piston move towards the check valve. Eventually, the bypass piston assembly is urged against the check valve with sufficient pressure to open the check valve, and to allow fluid to flow freely out of the cylinder. The elevator car is brought to a stop by again moving the needle valve, which moves the bypass piston assembly, causing the check valve to close.

The speed at which the needle valve moves is controlled according to the measured hydraulic pressures in the cylinder and in the first region. The needle valve is moved back and forth, at a rate which insures uniform acceleration or deceleration, over a constant time interval, regardless of the weight in the car. The movement of the needle valve is also controlled, by the microprocessor, according to the rate of fluid flow out of the second region, as measured by the turbine and Hall sensor assembly. This rate of flow varies between zero and a fixed maximum, depending on how much fluid is flowing across the valve element of the bypass piston, into the second region. When the elevator is ascending at constant speed, this flow rate is zero. When the elevator is descending at constant speed, this flow rate is at its maximum. The measured flow rate out of the second region also serves as a diagnostic check on the operation of the elevator; if the expected flow rates are not detected, the microprocessor can issue a warning signal or shut down the entire system.

The control valve of the present invention can be used in systems other than elevators. It can be used for control of a reciprocating piston, where the load on the piston is returned by gravity.

It is therefore an object of the present invention to provide a self-adjusting valve for controlling the operation of a hydraulic propulsion system for an elevator.

It is another object to provide a valve, as described above, wherein the valve does not need adjustment, other than its initial settings, and wherein the valve automatically compensates for changes in the load in the elevator car.

It is another object to increase the reliability of control valves for elevators.

It is another object to provide a control valve for an elevator, wherein the performance of the control valve is not significantly affected by dirt in the hydraulic lines.

It is another object to provide a microprocessor-controlled valve which insures smooth acceleration and deceleration of an elevator car.

It is another object to provide a control valve for an elevator, wherein the control valve is of modular construction, and wherein its hydraulic components are simpler and more reliable than those of valves of the prior art.

It is another object of the invention to provide a method of controlling the movement of a hydraulically-powered elevator car, wherein the acceleration and deceleration rates of the car are not significantly affected by the weight in the car.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
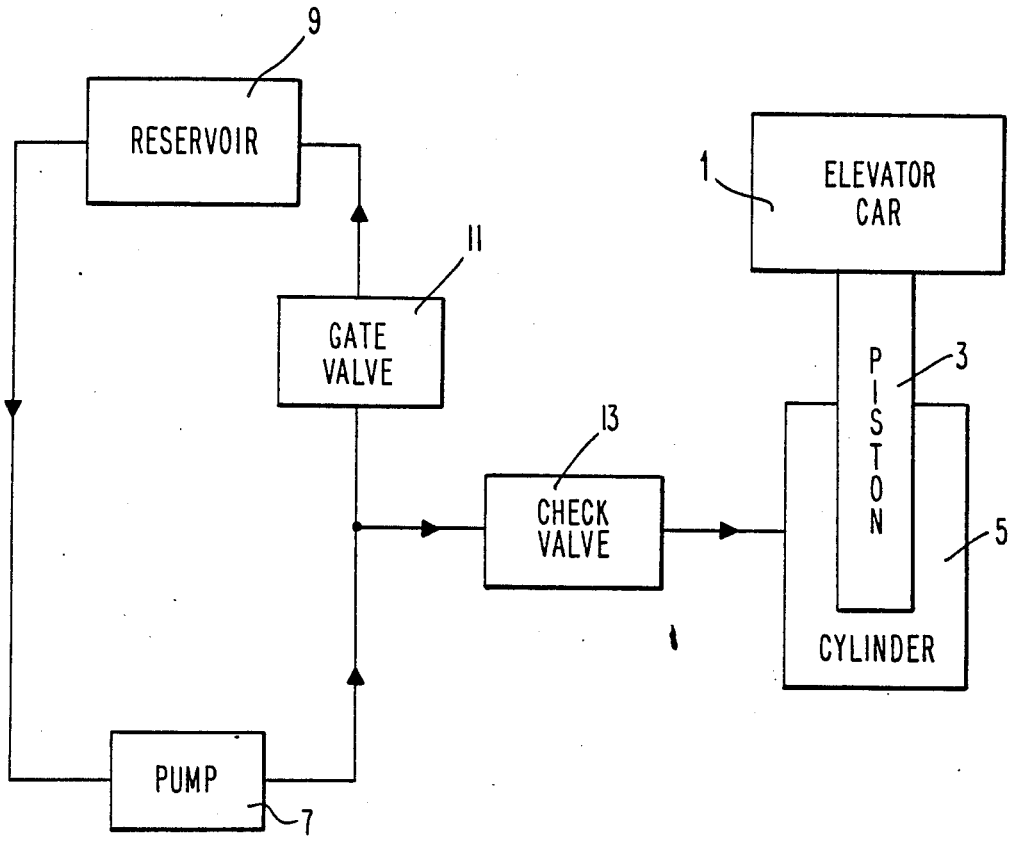
PRIOR ART Fig. 1
FIG. 1 is a schematic diagram showing the relationship of the control valve of the present invention to the other major components in a hydraulically-powered elevator system.

Before discussing the specific structure of the valve of the present invention, it is helpful to explain the context in which the valve is used. FIG. 1 is a schematic diagram showing the major components of a hydraulically-powered elevator system. Elevator car 1 is propelled by piston 3, which is disposed in cylinder 5. The cylinder contains a suitable hydraulic medium, such as oil.

Hydraulic fluid is pumped from reservoir 9 by pump 7, in the direction of the arrows. Fluid circulates between the pump and the reservoir if gate valve 11 is open. Check valve 13 allows fluid to flow into cylinder 5, but not in the other direction.

When the elevator car is not moving, check valve 13 is closed, and the car is held in its position by the hydraulic pressure in the cylinder. When it is desired to move the car upward, the gate valve is closed, causing an increase of fluid pressure in the region adjacent the check valve (to the left of the check valve, in FIG. 1). When the pressure in this region becomes sufficiently large, the fluid opens the check valve, and passes into the cylinder, raising the elevator car.

To lower the car, hydraulic fluid in the cylinder is allowed to flow out of the cylinder, through a conduit (not shown) which directs fluid from the cylinder to the reservoir.

The simple system of FIG. 1 is not practical, because of the sudden stops and starts that would be experienced when the gate valve is turned on and off. Therefore, it has been known to incorporate various cushioning means into the system of FIG. 1, to soften the impact of the sudden rush of pressurized fluid into the cylinder.

The control valve of the present invention performs the role of gate valve 11 and check valve 13 of FIG. 1.

Figure 2:
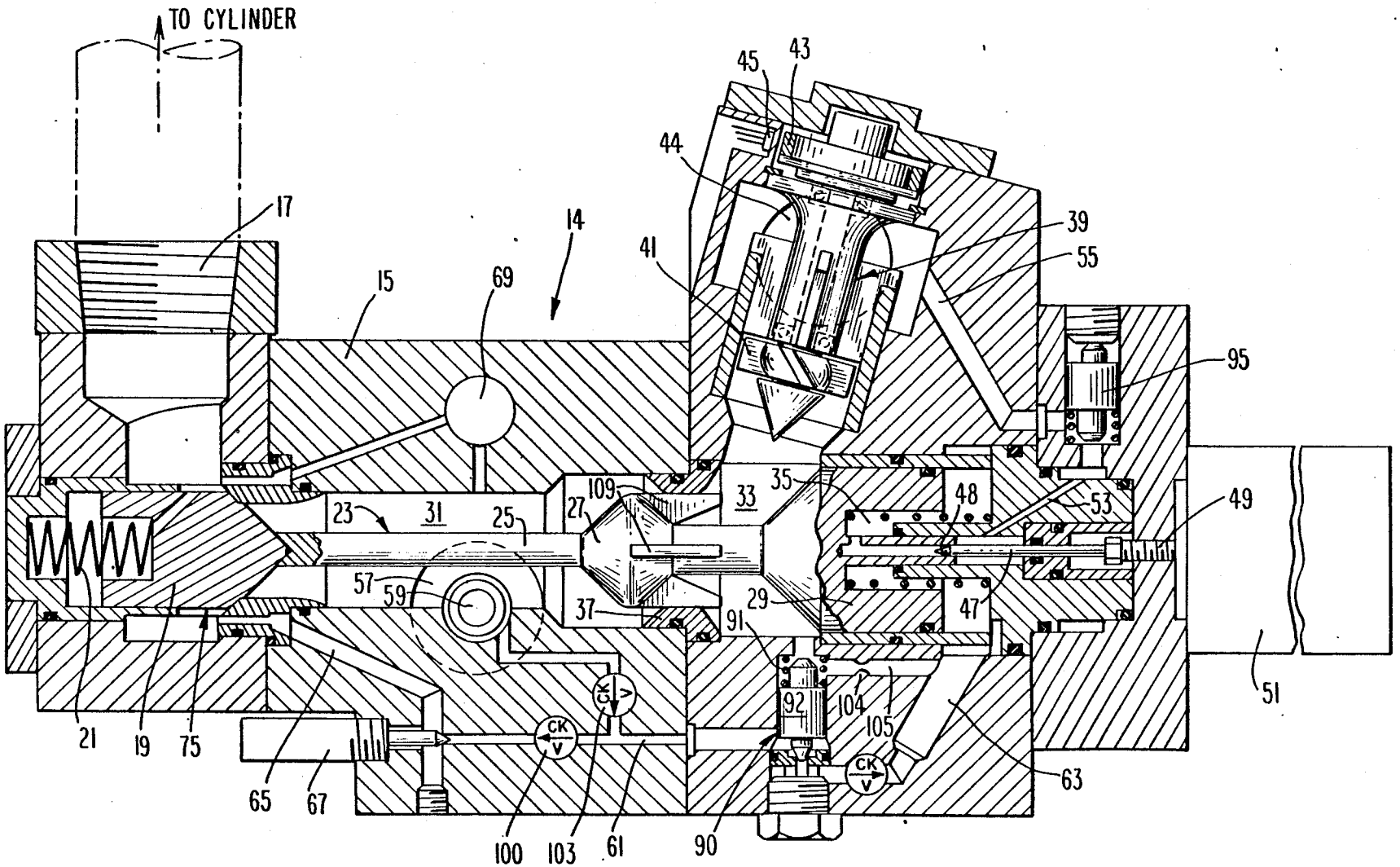
FIG. 2 is a cross-sectional view of the valve of the present invention, with some components indicated schematically.

FIG. 2 is a cross-sectional view showing the detailed structure of the control valve of the present invention. The control valve 14 is formed in housing 15. The housing includes means for connection of the valve 14 to the elevator cylinder. In FIG. 2, this connection means includes threaded connector 17.

Fluid flowing from the cylinder abuts check valve 75, built into control valve 14. The check valve includes sliding member 19 which is biased by spring 21.

Disposed within the control valve is bypass piston assembly 23, which includes rod 25, valve element 27, and bypass piston 29, all of which move together. The bypass piston assembly therefore reciprocates within the control valve. The assembly 23 divides the interior of the control valve into three regions, namely a first region 31, a second region 33, and a third region 35. When valve element 27 abuts projection 37, the valve element closes the fluid connection between region 31 and region 33. Projection 37 is provided with guide means for engaging fins 109 on the valve element, to insure that the valve element slides smoothly, and along a straight path.

The control valve also includes a turbine 39, in fluid communication with region 33. Fluid flowing out of region 33 causes turbine blades 41 to rotate. A multipole magnet 43 is mounted at the outside end of the turbine shaft. Hall effect sensor 45 is mounted on the valve housing, near the poles of the magnet. Hall sensor 45 is therefore positioned to convert the rotation of the turbine into a series of electrical pulses. The rate of fluid flow can be calculated by counting the pulses detected within a given interval. Conduit 44 is provided for returning the fluid to the reservoir (not shown) after it has passed through the turbine.

Needle 47, attached to screw 49, is located near region 35. The needle, which acts as a valve, can be moved back and forth by the action of the screw, which is controlled by motor 51. The motor itself can be controlled by a microprocessor (not shown in FIG. 2), or other suitable control means. The needle is tapered, as indicated by reference numeral 48, such that movement of the needle to the right, as shown in FIG. 2, creates an annular orifice of gradually increasing size, allowing fluid to flow out of region 35, through channel 53, and back to the reservoir through channel 55. The linear position of the needle is monitored by a suitable means, such as another Hall sensor and magent combination, not shown in FIG. 2.

The control valve includes a hydraulic fluid inlet 57, having non-return valve 59. Valve 59 is also a check valve, but it is called a non-return valve herein, so as not to confuse it with check valve 75, the main check valve for the system.

The inlet is connected to receive fluid from a pump, not shown in FIG. 2, which provides the fluid pressure for the system. Fluid from the inlet can enter region 31, and can also enter region 35, through channels 61 and 63. Channels 61 and 63 are pilot lines. That is, they are lines through which only small amounts of fluid can flow. The pump also provides fluid to region 35, through ball check valve 103. Valve 103 also has a flow restrictor.

The control valve also includes shuttle valve 90, which has a body 92 an spring 91. The spring biases the body in the down position, as shown in FIG. 2, thereby closing off the connection between channels 61 and 63. Pressure from fluid flowing in channel 61 forces body 92 upward, against spring 91, and opens a fluid connection with channel 63. The function of the shuttle valve will be described in more detail later.

Channel 65 provides a path for fluid flow from the cylinder to channel 61. The path between channel 65 and channel 61 is completed by actuation of solenoid valve 67. It is solenoid valve 67 which initially causes the elevator car to descend. The solenoid bleeds a small amount of fluid from the cylinder, as will be explained in more detail below. Fluid passing through the solenoid valve also passes through ball check valve 100. Ball check valve 100 includes a flow restrictor; as stated above, channel 61 is only a pilot line.

The invention also includes shuttle valve 95, which works in conjunction with a pressure relief valve (not shown), that provides overpressure relief.

The control valve also includes pressure sensor 69, which is shown only schematically in FIG. 2. Sensor 69 is fluidly connected, by appropriate fluid lines, to both the cylinder and to region 31, so that it can measure the pressures in both. Sensor 69 can therefore detect the difference in these pressures, as well as the individual pressures. Sensor 69 can be constructed with a Hall sensor which detects the movement of a magnet placed in the fluid lines. However, any other type of pressure sensor could be used.

Figure 3:
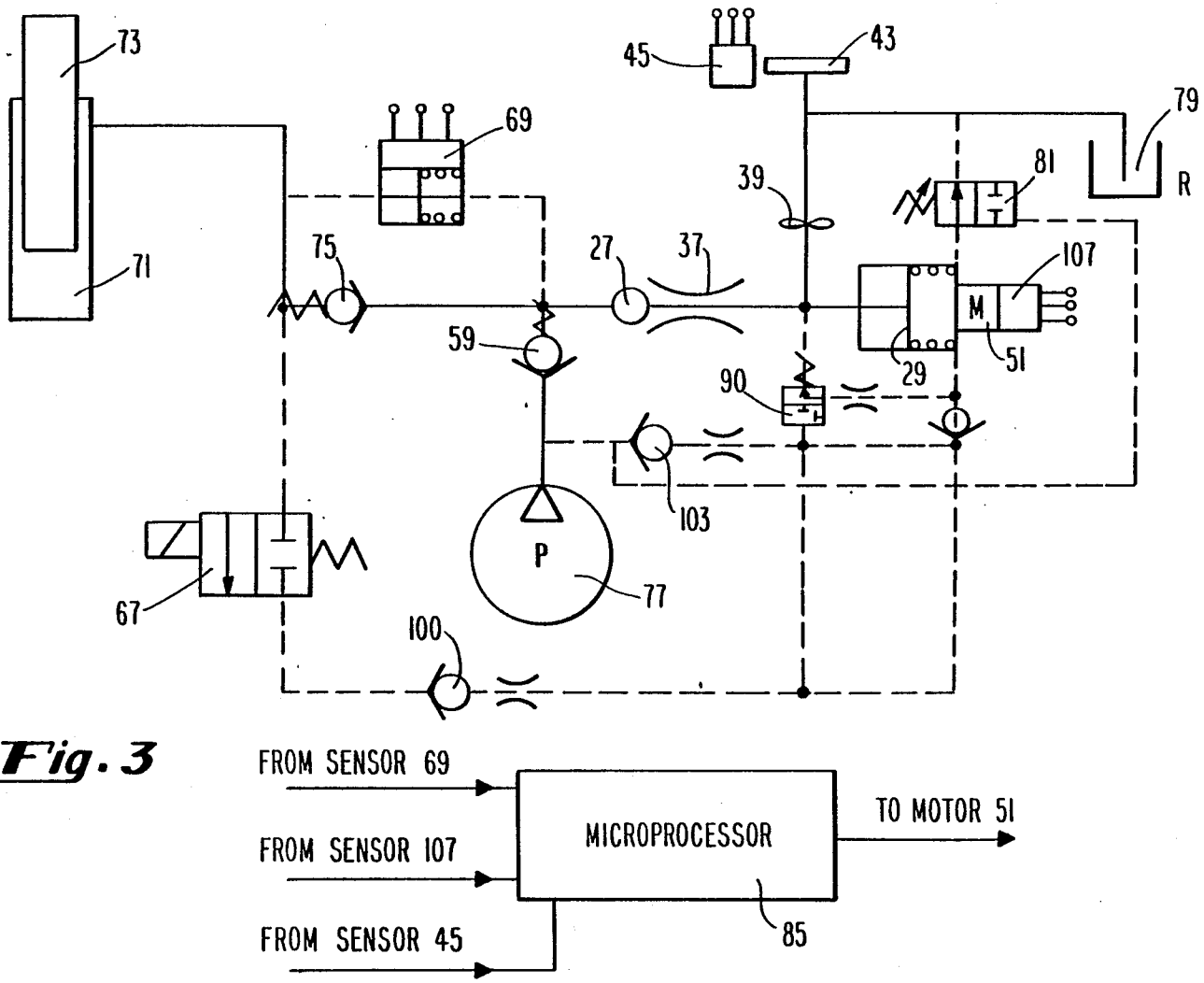
FIG. 3 is a schematic diagram of the valve of the present invention.

The major components shown in FIG. 2 are illustrated schematically in FIG. 3, together with other components which are external to the control valve. Items which are identical in these two figures are indicated by similar reference numerals. In FIG. 3, solid lines represent regular fluid flow lines, while the dotted lines indicate pilot lines, i.e. conduits with restricted flows. These pilot lines are used for control purposes only.

In FIG. 3, the elevator piston is shown symbolically as item 73, and the cylinder is shown as 71. Check valve 75 is the same as in FIG. 2. Projection 37 is also shown symbolically.

Hydraulic fluid is forced into the system by pump 77, through ball check valve 59. Fluid flowing past projection 37 drives turbine 39, which moves the magnet 43. Fluid which flows through the turbine is carried back to reservoir 79.

Hall sensor 45 is shown near magnet 43, as also shown and described in FIG. 1.

The position of bypass piston 29 is controlled by linear actuator motor 51, which moves the needle (not shown in FIG. 3). Pressure relief valve 81 can be adjusted to allow hydraulic fluid to escape to the reservoir when its pressure exceeds a predetermined level. Figure 3 also schematically shows Hall sensor 107, which monitors the linear position of the needle.

Solenoid valve 67 is also shown in FIG. 3. The solenoid valve opens a path for flow of fluid between cylinder 71 and region 35 (shown in FIG. 2).

Pressure sensor 69 is also shown in FIG. 3, and is connected both to the cylinder 71 and to region 31 (shown in FIG. 2).

Microprocessor 85 is connected to receive inputs from Hall sensor 45 (the pulse count sensor), Hall sensor 107 (the needle position sensor), and from pressure sensor 69. The output of the microprocessor is connected to motor 51, which moves the needle.

The operation of the invention can now be described. when the operation beings, it is assumed that the needle 47 is in the position which is midway between its extreme linear positions. This midpoint is called the "null" position. The microprocessor is programmed to place the needle in the null position before the end of each full cycle of operation. A "cycle" of operation includes moving the elevator car from rest, either up or down, and bringing it to rest at a new location. It is understood that the functions of the microprocessor can be performed by other electrical or electromechanical means.

Suppose that one wants to cause the elevator car to go up. The pump 77 is turned on, and fluid from the reservoir initially enters region 31. The microprocessor moves the needle to the right (as shown in FIG. 2), causing fluid in region 35 to exit the valve. The pressure in region 35 is momentarily lowered, causing the bypass piston assembly to move to the right. In practice, the actual distances traveled by the bypass piston and the needle are very small, and the two components can be viewed as moving together. That is, the bypass piston can be assumed to follow the needle with negligible lag.

The valve element 27 begins to constrict the space between regions 31 and 33, causing fluid pressure in region 31 to increase. The microprocessor operates the motor to move the needle as fast as possible, while monitoring the difference in pressure between the cylinder and region 31. Its aim is to move the valve element a sufficient distance to the right, such that this pressure difference will vanish. When the microprocessor determines that the pressure difference has reached zero, it first notes the current position of the needle. Then it calculates the rate of speed required to move the needle from this position to the position wherein the valve element will be virtually closed, within a desired time interval. The microprocessor then causes the motor to move the needle further to the right, at this calculated rate.

As the needle moves further to the right, the valve element 27 moves from a position of nearly closing off the flow of fluid to region 33, to a position where such flow is completely closed off. The pressure in region 31 increases, forces check valve 75 open, and forces fluid into the cylinder, causing the elevator car to ascend.

A typical time interval for moving the needle, from the point of zero pressure difference, to the point where the valve element is closed, is two seconds. This is the interval during which the elevator car will accelerate to full speed. An interval other than two seconds can be used; the selected interval is programmed into the microprocessor, and the microprocessor controls the speed of the needle such that the desired acceleration occurs within this interval.

From the discussion given above, it is seen that the control valve automatically compensates for varying loads on the elevator car. During the moments immediately before acceleration begins, the microprocessor is concerned with substantially equalizing the pressures in the cylinder and in region 31. The microprocessor seeks to equalize these pressures as quickly as possible. If the load on the elevator is great, the cylinder pressure will be much greater than that in region 31. If the elevator car is empty, the difference in pressures will not be as great. In the former case, the microprocessor causes the motor 51 to act rapidly while closing the valve element, to allow the pressure in region 31 to increase to match the pressure in the cylinder. Only after these pressures are equal, as detected by the pressure sensor, does the microprocessor begin the final movement of the needle which causes the valve element to close during the twosecond interval. But in the case where the load on the elevator car is light, and the pressures in the cylinder and in region 31 are substantially equal, the microprocessor may cause the piston to move, with one motion, to the closed off position, in the same two-second (or other predetermined) interval. In either case, the acceleration takes place over the same time interval, because the acceleration does not begin until the pressures are equalized.

Meanwhile, the microprocessor is monitoring the rate at which pulses emanate from Hall sensor 45. When the valve element is completely closed, no fluid can flow through the turbine, and the pulse count will be zero. If the microprocessor detects a pulse count which is significantly above zero, while the valve element is closed, it can issue a warning signal, or can be programmed to stop the entire system.

If the pulse count is zero, as expected, the car has reached its maximum speed, and will continue to ascend with uniform velocity, because all of the fluid forced out of the pump is being directed into the cylinder. The constant speed of the elevator car, known also as the "contract speed", is determined only by the speed of the pump which forces fluid into the cylinder.

When the elevator car, moving up at constant speed, approaches the selected floor, it encounters the first of three switches in the elevator shaft. These switches are not shown in the drawings, but they are of conventional design. The first switch, known as the "near floor switch", triggers a signal which is fed to the microprocessor. The microprocessor then advanced the needle to the left. Moving the needle to the left moves the bypass piston assembly to the left, because the fluid pressure in region 35 is momentarily increased by the change in position of the needle, and due to the fact that fluid continues to flow into that region from pump 77, through channel 61. The microprocessor has stored, in its memory, the speed at which the needle was moved to accelerate the car. It now moves the needle to the left at this same speed, plus or minus a constant which may be stored in memory.

As the needle moves to the left, the bypass piston assembly does likewise, and the fluid connection between regions 31 and 33 is again opened. Fluid flows from region 31, through region 33, and through turbine 39. The pulse count immediately rises from zero. The microprocessor now waits until the pulse rate reaches 85% of its final value. The "final value" is either a value which is preprogrammed, or one which is stored from the last steady-state operation of the elevator, i.e. the period of uniform speed of the car. As the pulse rate increases towards the 85% level, most of the fluid is flowing through the turbine, and not into the cylinder, and the elevator car is therefore decelerating. The check valve 75 becomes gradually more constricted. Note that the rate of deceleration is the same as the rate of acceleration, because the needle is moved at the same rate as it was moved to accelerate the car. Both rates may be trimmed, plus or minus, within predetermined limits.

The figure of 85% is somewhat arbitrary, and can be altered. What is important is that the microprocessor recognize when the elevator car has "almost" reached its destination.

When the pulse rate reaches the 85% level, the microprocessor stops the needle. The valve element is no longer being opened further, i.e. the bypass piston is no longer being pushed to the left. The rate of flow of fluid into the turbine increases no further. The microprocessor then waits for the second of the three stop signals, known as the "prestop" signal, from the elevator shaft. When this signal is received, indicating that the desired floor has been reached, the microprocessor moves the needle slowly to the left at a fixed, pre-programmed rate, towards the null position. The elevator car is slowly ascending to its final position. Then, when the microprocessor detects the final external signal, the "stop" signal, it moves the needle further to the left, towards the null position, as fast as possible. When the microprocessor has sensed that the needle is in the null position, and that the pulse count is at the 100% level, indicating that no fluid is flowing into the cylinder, it turns off the pump, and the cycle is complete. It is important, for the correct operation of the next cycle, that the needle be in the null position before the pump is turned off.

To make the elevator go down, solenoid valve 67 is energized. The solenoid remains energized for the entire time during which the elevator is descending. The solenoid valve allows a limited amount of hydraulic fluid to flow from the cylinder, towards region 35. This flow is restricted by ball check valve 100. The fluid that does enter region 35 creates a pressure imbalance which pushes the bypass piston to the left. At the same time, the microprocessor moves the needle to the left, so as to urge the bypass piston to the left. Because the needle and bypass piston essentially move together, the pressure in region 35 is maintained, and even increased, as the piston moves to the left. Eventually, the pressure on the bypass piston is sufficient to open the main check valve. The fluid leaves the cylinder at a rate which is much greater than that with which it flows through the solenoid valve, causing the elevator car to descend rapidly.

The movement of the needle is timed in accordance with the sensed pressure in the cylinder. If the pressure in the cylinder is low, indicating that the load on the elevator car is small, the microprocessor moves the needle more rapidly to the left. If the pressure in the cylinder is high, the needle is moved more slowly. The microprocessor can be preprogrammed to move the needle at a rate which will accelerate the car to the desired final speed within the desired interval (say, two seconds). This preprogramming would be based on a set of calculations, performed in advance, the results of which are stored, in tabular form, in the microprocessor memory.

Alternatively, the microprocessor can be programmed to control the needle dynamically. The initial movement of the needle can be correlated with the speed of the car, as measured by the pulse count generated by Hall sensor 45. That is, the microprocessor observes the downward movement of the elevator over a very small time interval, of the order of milliseconds. The microprocessor then corrects the speed of the needle to produce the desired acceleration over the entire interval (which is typically two seconds). Either means of control of the needle speed is within the scope of the invention.

When fluid begins to flow out of the cylinder and through the check valve, the turbine also begins to move, and the microprocessor will sense that the pulse count increases from zero. The microprocessor checks that the pulse count reaches 100% of its maximum expected rate. If this rate is not reached within an expected time, the microprocessor can issue a warning signal or stop the entire system. While the elevator car is descending at uniform speed, the needle is stopped in its last position. This is the position at which the microprocessor determines that the pulse count has reached the 100% level.

When the elevator car approaches the selected floor, it encounters the first of the three switches, in the elevator shaft. As before, these switches are the "near floor" switch, the "prestop" switch, and the "stop" switch. The microprocessor first receives the signal indicating the actuation of the near floor switch. The microprocessor must now retract the needle, i.e. move it to the right, to decelerate the car.

The microprocessor has stored, in its memory, the speed at which the needle was moved during the last operation, i.e. the opening of the check valve. The microprocessor will now move the needle at this same rate, in the opposite direction, i.e. to the right. The system assumes that the load on the car is the same at the end of the cycle as at its beginning. This assumption is equivalent to saying that no passengers or cargo have left the elevator car while it is in motion.

The microprocessor moves the needle to the right. This motion tends to reduce momentarily the pressure in region 35, and therefore causes the bypas piston assembly also to move to the right. As the valve element 27 moves to the right, the flow of fluid from region 31 to region 33 becomes more restricted, and the microprocessor will sense a reduction in the pulse rate from sensor 45.

The microprocessor waits for the pulse count to decrease to 15% of its maximum value. When this condition is reached, the microprocessor stops the needle, and waits for the prestop signal, from the next switch in the elevator shaft. When the prestop switch is actuated, the microprocessor causes the motor to move the needle further to the right, at a preprogrammed, fixed, slow rate. When the microprocessor obtains the signal from the third switch in the elevator shaft, the "stop" switch, it moves the needle to the null position as fast as possible, and simultaneously de-energizes the solenoid of solenoid valve 67. This combined action allows check valve 75 to close, stopping the flow into region 31. The pulse count is zero. The microprocessor checks the position of the needle, and moves it to the null position, if necessary. The cycle is now complete.

Shuttle valve 90 protects the elevator in the event of a system malfunction. While the elevator car is descending, it may happen that the microprocessor finds that it is unable to move the needle. In this case, the microprocessor will deactivate the solenoid. When the solenoid is deactivated, fluid no longer can flow through the solenoid valve, and to shuttle valve 90. Shuttle valve 90 therefore returns to its normal position, i.e. blocking the connection between channels 61 and 63. At the same time, the upper portion of the shuttle valve will be opened, providing a fluid connection between region 35 and region 33, through channel 105, which has restriction 104. Thus, the fluid in region 35 will exit the system through region 33, and through the turbine, and the pressure in region 35 will be reduced. The bypass piston assembly will no longer be able to hold open the check valve 75, and the check valve will close. The elevator car will therefore immediately stop.

Figure 4:
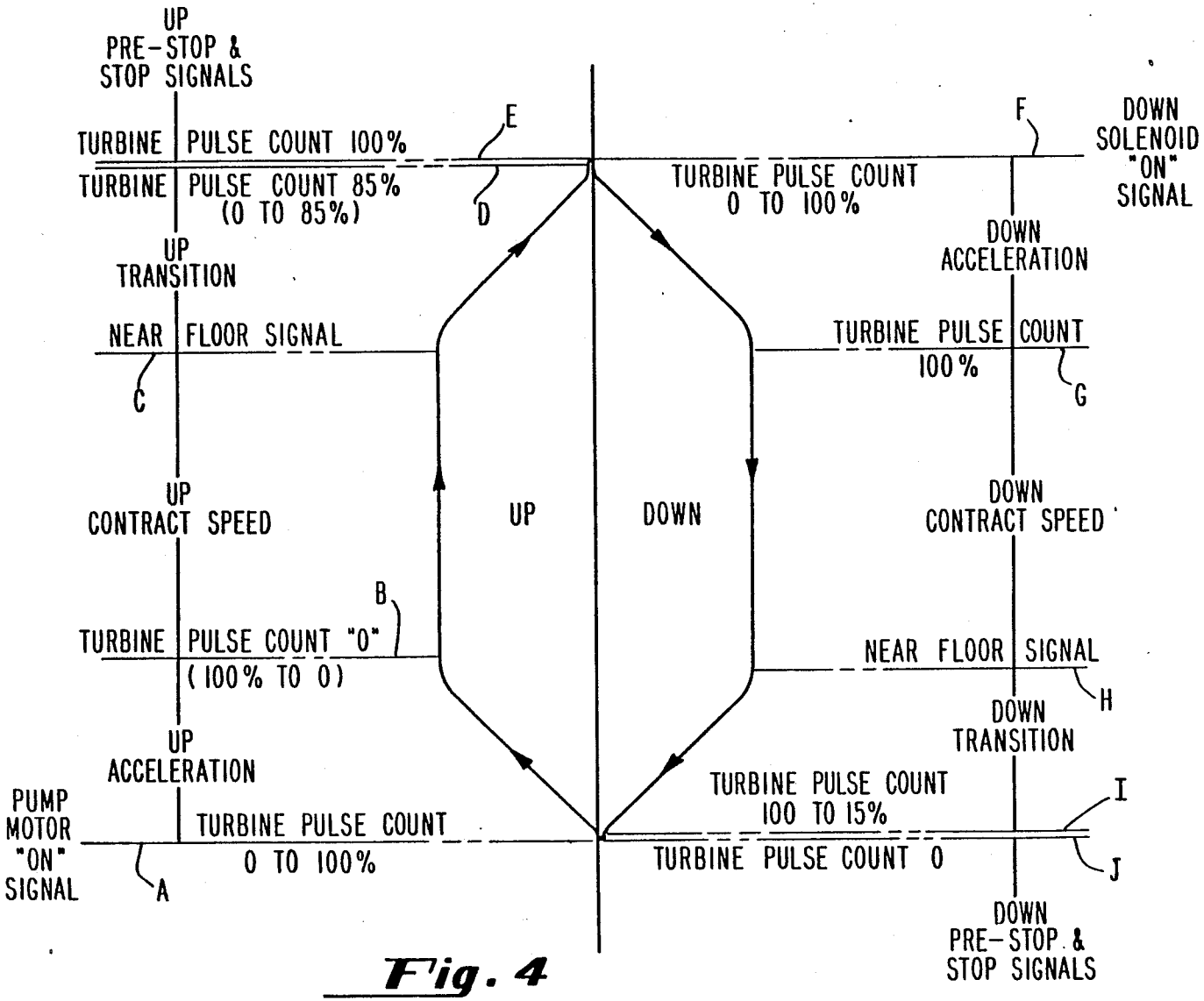
FIG. 4 is a diagram illustrating the velocity of the elevator car, as a function of time, as the car is moved up and down.

FIG. 4 summarizes the movements of the elevator car through an "up" cycle and a "down" cycle. The vertical axis represents time, and the horizontal axis represents velocity. The horizontal lines represent the various conditions which are sensed by the microprocessor.

FIG. 4 shows the the "up" cycle begins when the pump motor is turned on, at line A, and the turbine pulse count is quickly increased from zero to 100% of its maximum value. A pulse count at the 100% level signifies that the pump is on, but that no fluid is flowing into the cylinder. The car is then accelerated to its maximum speed, at which time all of the fluid is flowing into the cylinder, and the pulse count decreases to zero. This condition is illustrated symbolically at line B.

The elevator car then proceeds upward, at the constant contract speed, as determined by the pump speed. At line C, the microprocessor encounters the "near floor" signal, which indicates that the car is approaching the desired floor, and that it should begin to decelerate. The micorprocessor causes the deceleration of the car, as described above, until the turbine pulse count has increased to 85% of its maximum value. At about this same time, the microprocessor receives the signal from the prestop switch, indicated at line D. The microprocessor then causes the car to proceed upward, very slowly, until the stop signal, at line E, is reached.

The "down" cycle is illustrated on the right-hand portion of FIG. 4. At line F, the solenoid valve is energized, and the microprocessor causes the fluid to flow out of the cylinder, as described above. At line G, the pulse count has reached 100% of its maximum value, indicating that the maximum amount of fluid is flowing out of the cylinder, through the turbine, and back to the reservoir. The car proceeds to descend at the constant contract speed.

At line H, the microprocessor receives the near floor signal, and causes the car to decelerate, as described above. At line I, the turbine pulse count has decreased to 15% of its maximum value, and the microprocessor halts the movement of the needle until its detects the prestop signal. When the prestop signal is detected, the microprocessor causes the car to move very slowly, until the stop signal is reached, at line J. The microprocessor then stops the car, and insures that the needle is in the null position. The cycle is complete.

The structure of the control valve of the present invention is quite modular. That is, the components of the valve, such as the turbine and the check valve, can be easily removed and replaced. The hydraulic components of this valve are, in general, much simpler than those of control valve of the prior art, and this simplicity is an additional advantage of the invention.

The invention is not limited to use in elevator systems. In fact, it can be used in any cylinder extension or retraction system, wherein the load is returned by gravity.

It is understood that many variations can be made in the invention. For example, it is not absolutely necessary to use a microprocessor, but other equivalent electrical or electromechanical devices can be employed. The precise designs of the motors, sensors, and other components, are not critical. The flow of fluid out of the valve can be measured by means other than a turbine. The time intervals discussed above are only exemplary; other intervals can be used. These and other similar modifications should be considered within the spirit and scope of the following claims.

What is claimed is:

1. A self-adjusting control valve for a hydraulically-operated elevator propulsion system, the system having a cylinder within which a piston is moved by the pressure of a hydraulic medium, the valve comprising:

(a) means defining a housing, the housing defining an interior chamber, (b) means for fluidly connecting the cylinder to the chamber, (c) a bypass piston assembly, the bypass piston assembly comprising means for dividing the chamber into three regions, the first region being nearest to the connecting means, the third region being farthest from the connecting means, (d) a check valve, positioned between the connecting means and the first region, wherein the opening of the check valve means enables fluid to flow between the cylinder and the first region, wherein the bypass piston assembly includes a valve element which opens and closes a path between the first and second regions, wherein the filling of the first region, when the valve element is closed, causes sufficient pressure buildup in the first region to cause the check valve means to open and to force hydraulic fluid into the cylinder, (e) means for directing hydraulic fluid from a reservoir into the first region, and a pilot line for directing fluid from the reservoir into the third region, (f) means for conveying hydraulic fluid out of the second and third regions, and back to the reservoir, (g) means for measuring the rate of flow of fluid out of the second region, (h) means for measuring the pressures in the first region and in the cylinder, (i) needle valve means for varying the rate of fluid flow out of the third region, the needle valve means being capable of being moved by a motor means, (j) means for monitoring the linear position of the needle valve means, (k) a microprocessor, the microprocessor being connected to receive inputs from the flow measuring means, the pressure measuring means, and the monitoring means, the microprocessor being programmed to control the motor means, so as to move the needle valve means, wherein movement of the needle valve means changes the pressure difference between the first and third regions, whereby movement of the needle valve means causes movement of the bypass piston assembly, and (l) a solenoid valve, fluidly connected to the cylinder, and fluidly connected to the third region, the solenoid valve, when actuated, completing a path for fluid out of the cylinder and into the reservoir, the solenoid valve being connected for actuation by the microprocessor, whereby the elevator can be lowered by allowing fluid to exit the cylinder.

2. The valve of claim 1, wherein the flow measuring means comprises a turbine, positioned to be rotated by fluid leaving the second region, the turbine being connected to a magnet, and a Hall sensor positioned near the magnet, so as to generate pulses proportional to the rate of rotation of the turbine.

3. The valve of claim 2, wherein the pressure measuring means comprises a Hall sensor, and a pair of fluid lines connected to the cylinder and to the first region, wherein the Hall sensor detects the movement of a magnet in said fluid lines.

4. The valve of claim 3, wherein the monitoring means comprises a Hall sensor disposed to receive a signal from a magnet attached to the needle valve means.

5. A self-adjusting control valve for a hydraulically-operated elevator propulsion system, the system having a cylinder within which a piston is moved by the pressure of a hydraulic medium, the piston being adapted to move an elevator car, the control valve comprising:

(a) means defining a housing, the housing defining an interior chamber, (b) means for fluidly connecting the cylinder to the chamber, (c) a bypass piston assembly, the bypass piston assembly comprising means for dividing the chamber into three regions, the first region being nearest to the connecting means, the third region being farthest from the connecting means, (d) check valve means, positioned between the connecting means and the first region, wherein the opening of the check valve means enables fluid to flow between the cylinder and the first region, wherein the bypass piston assembly includes a valve element which opens and closes a path between the first and second regions, wherein the filling of the first region, when the valve element is closed, causes sufficient pressure buildup in the first region to cause the check valve means to open and to force hydraulic fluid into the cylinder, (e) means for directing hydraulic fluid from a reservoir into the first region and also into the third region, (f) means for conveying hydraulic fluid out of the second and third regions, and back to the reservoir,
(g) means for measuring the rate of flow of fluid out of the second region,
(h) means for measuring the pressures in the first region and in the cylinder,
(i) needle valve means for varying the rate of fluid flow out of the third region, and
(j) control means, the control means being connected to the flow measuring means and the pressure measuring means, the control means being programmed to move the needle valve means, wherein movement of the needle valve means changes the pressure difference between the first and third regions, whereby movement of the needle valve means causes movement of the bypass piston assembly.

6. The valve of claim 5, wherein the directing means includes a pilot line for directing fluid to the third region.

7. The valve of claim 5, further comprising a solenoid valve, fluidly connected to the cylinder, and fluidly connected to the third region, the solenoid valve being adapted for actuation by the control means, the solenoid valve being capable of completing a path for fluid flow from the cylinder to the reservoir, whereby the elevator car can be lowered.

8. The valve of claim 5, wherein the control means includes a microprocessor.

9. The valve of claim 5, further comprising means for monitoring the linear position of the needle valve means, the output of the monitoring means being connected to the control means.

10. The valve of claim 8, further comprising motor means, operatively connected to the microprocessor, for moving the needle valve means.

11. A self-adjusting control valve for a hydraulically-operated elevator propulsion system, the system having a cylinder within which a piston is moved by the pressure of a hydraulic medium, the valve comprising:
(a) check valve means, positioned to contain the hydraulic fluid within the cylinder,
(b) a bypass piston assembly, mounted for reciprocating movement, and being in abutment with the check valve means, so as to open or close the check valve means, the bypass piston assembly defining three cavities within the control valve,
(c) means for separately introducing hydraulic fluid into the first and third cavities, to influence the movement of the bypass piston assembly by the difference in pressure on either side of the assembly,
(d) needle valve means for controlling the rate of flow of fluid out of the third cavity,
(e) means for measuring the pressure in the cylinder and in the first region,
(f) means for measuring the rate of flow of fluid out of the second cavity, and
(g) control means, connected to the pressure and flow measuring means, the control means being capable of moving the needle valve means, wherein movement of the needle valve means causes movement of the bypass piston assembly, and wherein movement of the bypass piston assembly causes the check valve to open or close.

12. The valve of claim 11, further comprising means for monitoring the position of the needle valve means, the monitoring means being connected to the control means, wherein the control means can move the needle valve means in response to information about the position of the needle valve means.

13. The valve of claim 12, wherein the control means includes a microprocessor, the microprocessor being operatively connected to a motor means, the motor means being capable of moving the needle valve means.

14. The valve of claim 13, further comprising solenoid valve means fluidly connected to the cylinder and to the third cavity, for directing fluid out of the cylinder and into the third cavity, the solenoid valve means comprising means for initiating the descent of the elevator.

15. A control valve for an elevator propulsion system, the propulsion system including a cylinder containing hydraulic fluid, the control valve comprising:
(a) means for directing hydraulic fluid from a reservoir, through the control valve, and back to the reservoir,
(b) bypass valve means, within the control valve, for adjustably directing hydraulic fluid, from the reservoir, into the cylinder and into the reservoir, in variable amounts,
(c) means for sensing the pressure of the hydraulic fluid within the control valve, and for sensing the pressure in the cylinder, and
(d) means for controlling the movement of the bypass valve means, the controlling means being connected to the sensing means, wherein the rate of movement of the bypass valve means is in response to the sensed pressure difference between the fluid in the cylinder and the fluid in the control valve, wherein the hydraulic fluid can be directed into the cylinder or into the reservoir, in accordance with the pressures in the cylinder and in the control valve, whereby the control valve automatically compensates for changes in the weight of the elevator.

16. A control valve for an elevator propulsion system, the propulsion system including a cylinder containing hydraulic fluid, the control valve comprising:
(a) means for directing hydraulic fluid from a reservoir, through the valve, and back to the reservoir,
(b) bypass valve means, within the control valve, for adjustably directing hydraulic fluid, from the reservoir, into the cylinder and into the reservoir, in variable amounts,
(c) means for sensing the pressure of the hydraulic fluid in the cylinder, and
(d) means for controlling the movement of the bypass valve means, the controlling means being connected to the sensing means, wherein the rate of movement of the bypass valve means is in response to the sensed pressure in the cylinder, wherein the hydraulic fluid can be directed out of the cylinder and into the reservoir, at a rate which makes the elevator descend with a desired uniform acceleration, regardless of the weight of the elevator.

17. A control valve for an elevator propulsion system, the propulsion system including a cylinder containing hydraulic fluid, the control valve comprising:
(a) a bypass valve, disposed within the control valve, for directing variable amounts of hydraulic fluid, from a reservoir, into the cylinder or back to the reservoir,
(b) means for sensing the pressure of the hydraulic fluid in the cylinder and in the control valve, and (c) means for controlling the movement of the bypass valve, the controlling means being connected to the sensing means, wherein the rate of movement of the bypass valve is controlled according to the sensed pressure difference between the fluid in the cylinder and the fluid in the control valve, when the elevator is ascending, and wherein the rate of movement of the bypass valve is controlled according to the sensed pressure in the cylinder, when the elevator is descending, whereby the control valve automatically compensates for changes in the weight of the elevator.

18. A control valve for a reciprocating piston, the piston being mounted for extension and retraction within a cylinder containing hydraulic fluid, the piston being upwardly extendable against the force of gravity, the control valve comprising:

(a) a bypass valve, disposed within the control valve, for directing variable amounts of hydraulic fluid, from a reservoir, into the cylinder or back to the reservoir, (b) means for sensing the pressure of the hydraulic fluid in the cylinder and in the control valve, and (c) means for controlling the movement of the bypass valve, the controlling means being connected to the sensing means, wherein the rate of movement of the bypass valve is controlled according to the sensed pressure difference between the fluid in the cylinder and the fluid in the control valve, when the piston is being extended, and wherein the rate of movement of the bypass valve is controlled according to the sensed pressure in the cylinder, when the piston is being retracted, whereby the control valve automatically compensates for changes in the size of the load on the piston.

19. A method of controlling the upward movement of a hydraulically-powered elevator, the elevator comprising a piston which is propelled hydraulically within a cylinder, the elevator also having a control valve, the control valve being fluidly connected to the cylinder, and to a source of hydraulic pressure, and to a reservoir, the control valve having a valve element capable of directing hydraulic fluid from the reservoir, and into the cylinder or back to the reservoir, the method comprising the steps of:

(a) adjusting the valve element so as to equalize the difference in fluid pressure between the fluid in the cylinder and the fluid in the control valve, and (b) moving the valve element during a predetermined time interval, so as to close the path for fluid from the valve to the reservoir, such that the fluid cannot escape from the valve, wherein the fluid is forced into the cylinder.

20. The method of claim 19, further comprising the steps of:

(a) retracting the valve element so as to allow fluid to escape from the control valve to the reservoir, the retracting step being performed during substantially the same interval used in the moving step, the retracting step causing a reduction of fluid flow into the cylinder, whereby the rate of upward motion of the elevator is decreased, (b) sensing when the desired floor is reached, and (c) stopping the elevator.

21. The method of claim 20, wherein the sensing step includes the step of halting the movement of the valve element, and wherein the stopping step comprises the step of moving the valve element slowly, at a predetermined speed, towards its original position, until the elevator is stopped.

22. A method of controlling the downward movement of a hydraulically-powered elevator car, the elevator comprising a piston which is propelled hydraulically within a cylinder, the elevator having a control valve, the control valve being fluidly connected to the cylinder, and to a source of hydraulic pressure, and to a reservoir, the control valve having a valve element capable of directing hydraulic fluid from the reservoir, and into the cylinder or back to the reservoir, the method comprising the steps of:

(a) sensing the pressure in the cylinder, (b) adjusting the valve element so as to allow fluid to flow out of the cylinder and into the reservoir, the movement of the valve element being controlled according to the sensed pressure in the cylinder, and (c) moving the valve element so as to restrict the fluid flow from the cylinder to the reservoir, the valve element being moved in the opposite direction, and at the same linear speed, in which it was moved in the adjusting step.

23. The method of claim 22, wherein the moving step is performed in response to detection of the actuation of an external switch signifying that the elevator car is approaching the desired floor.

24. The method of claim 23, wherein the moving step further comprises the steps of detecting the actuation of an external switch indicating that the elevator car has nearly reached the desired floor, and advancing the valve element at a predetermined slow rate, in the same direction as in the moving step, the valve element being advanced sufficiently to stop the flow of fluid out of the cylinder, wherein the elevator is stopped.

25. A method of controlling the movement of a hydraulically-powered elevator car, the elevator comprising a piston which is propelled hydraulically within a cylinder, the elevator having a control valve, the control valve being fluidly connected to the cylinder, and to a source of hydraulic pressure, and to a reservoir, the control valve having a valve element capable of directing hydraulic fluid from the reservoir, and into the cylinder or back to the reservoir, the method comprising the steps of:

(a) sensing the pressure in the cylinder and within the control valve, and (b) moving the valve element, in response to the difference in pressure between the cylinder and the control valve, when the elevator is ascending, and in response to the pressure in the cylinder, when the elevator is descending, the valve element being moved at a rate that makes the elevator car accelerate or decelerate at the same, uniform, rate, regardless of the load in the elevator car.

26. A method of controlling the movement of a reciprocating piston, the piston being mounted for extension and retraction within a cylinder containing hydraulic fluid, the piston being upwardly extendable against the force of gravity, the piston being controlled by a control valve, the control valve being fluidly connected to the cylinder, and to a source of hydraulic pressure, and to a reservoir, the control valve having a valve element capable of directing hydraulic fluid from the reservoir, and into the cylinder or back to the reservoir, the method comprising the steps of:

(a) sensing the pressure in the cylinder and within the control valve, and (b) moving the valve element, in response to the difference in pressure between the cylinder and the control valve, when the piston is being extended upwardly, and in response to the pressure in the cylinder, when the piston is being retracted, the valve element being moved at a rate that makes the piston accelerate or decelerate at the same, uniform, rate, regardless of the load on the piston.

* * * * *